United States Patent [19]

Craig, Jr. et al.

[11] 3,961,674

[45] June 8, 1976

[54] DIRECTIONAL DRILLING SYSTEM

[75] Inventors: James T. Craig, Jr., Bixby; Arthur Park, Tulsa, both of Okla.

[73] Assignee: Standard Oil Company, Chicago, Ill.

[22] Filed: July 11, 1974

[21] Appl. No.: 487,482

[52] U.S. Cl. ..... 175/325; 175/45; 175/73; 175/76

[51] Int. Cl.[2] ..... E21B 7/10

[58] Field of Search ..... 64/2 R, 2 P; 175/325, 175/320, 61, 73–78, 256; 308/4 A

[56] References Cited

UNITED STATES PATENTS

| | | | |
|---|---|---|---|
| 831,143 | 9/1906 | Conrader | 308/4 A |
| 2,266,383 | 12/1941 | Quintrell | 175/156 X |
| 2,304,119 | 12/1942 | Potts | 175/61 X |
| 2,710,170 | 6/1955 | Livingston et al. | 175/61 X |
| 2,829,864 | 4/1958 | Knapp | 175/325 |
| 3,411,837 | 11/1968 | Schellstede | 308/4 A |

*Primary Examiner*—Frank L. Abbott
*Assistant Examiner*—Richard E. Favreau
*Attorney, Agent, or Firm*—John D. Gassett; Paul F. Hawley

[57] ABSTRACT

This invention concerns the drilling of boreholes in the earth. It concerns a rotary drilling system having a particular bottom hole assembly (BHA) for use in increasing or decreasing the angle of deviation from the vertical of a borehole. It also teaches a method whereby the angle of deviation can be calculated for each assembly. There is one assembly disclosed for increasing the angle of deviation and another assembly disclosed for decreasing the angle of deviation. Also disclosed is a novel "universal stabilizer" for use in the bottom hole assembly.

6 Claims, 8 Drawing Figures

DIRECTIONAL DRILLING SYSTEM

BACKGROUND OF THE INVENTION

1. Field of the Invention

This invention relates to the drilling of boreholes in the earth. It relates especially to methods and downhole assemblies, one downhole assembly being used to increase the angle of deviation of the wellbore from the vertical, and the other bottom hole assembly being used for decreasing the angle of deviation of the borehole from the vertical. It also relates especially to special equipment used in the bottom hole assembly to effect the desired drilling.

2. Setting of the Invention

Oil and gas are produced from underground formations through wellbores drilled from the surface to the formation. Originally, it was desired to drill the well in as nearly a vertical direction as possible. However, in some cases, due to the particular geometry of the underground formation, it is nearly impossible to drill vertical wells. This is particularly true in steeply dipping formations in which the well keeps wanting to veer off to the updip side. Means are then required to cause the well to drill in the opposite direction. These tools which have been used for this purpose are ordinarily called directional drilling tools. Recently, it has become increasingly popular to drill wells in oriented directions. This is particularly true of offshore production. In those areas, a platform may be erected in water 100 feet to 200 feet or more deep, and many wells drilled from a single platform. The wells will not be drilled in a vertical position, but will be drilled in a slanting or directional position in order to reach a particular subsurface location in the producing formation, which may be 1 or 2 miles in a lateral direction from the location of the platform.

There are numerous directional drilling tools, and there have also been numerous articles published on directional drilling techniques. One of the earliest and still one of the best articles published on the use of stabilizers in downhole assemblies used in controlling hole deviation is the article by H. B. Woods and Arthur Lubinski, entitled "Use of Stabilizers in Controlling Hole Deviation," and presented at the Spring Meeting of the Mid-Continent District Division of Production, Amarillo, Tex., March 1955, and published in *Drilling and Production Practice*, 1955. As stated in that article, when weight is applied to their bottom hole assembly, there is a force which is detrimental when weight is applied, because it tends to direct the hole away from vertical. We teach a method whereby the bottom hole assembly can be selected and in which weight can be applied and still decrease the angle of deviation; or, if desired, we can select a bottom hole assembly to increase the direction of deviation.

BRIEF DESCRIPTION OF THE INVENTION

This invention concerns a method of drilling a well including determining if a BHA (bottom hole assembly) of a drill string used in drilling a well is stable for an angle $\theta_o$ of deviation from the center line of the wellbore and in which the BHA includes a bit, a stabilizer, a lower section of heavy-walled pipe called drill collars having a length "X" between the bit and the stabilizer. We first determine whether the angle $\theta_o$ (which is the angle the center line of the lower section of the heavy-walled pipe makes with the center line of the borehole) is positive, i.e., center line of the lower section of heavywalled pipe is above the center line of the borehole or if the angle $\theta$ is negative. If the angle $\theta_o$ is positive, then we conclude that the BHA is stable, and we can proceed with drilling the borehole. If we determine that the angle $\theta_o$ is negative, we decrease the length X and redetermine the angle $\theta$ and repeat this step until the angle $\theta$ is positive. If the BHA includes only a bit and one stabilizer which is relatively close, i.e., 30 feet to 60 feet, of the drill bit, and there is no other centralizer for a considerable distance of the borehole, i.e., several hundred feet, then we know that the BHA will cause the bit to drill at a decreasing angle of deviation if $\theta$ is found to be positive. This is true even though we may apply considerable weight to the string.

If the BHA includes a bit, a lower section of heavy walled pipe, a stabilizer or centralizer, an upper section of heavy walled pipe of a relatively short length, e.g., 30 feet to 60 feet, and then another centralizer, we know that this particular BHA will increase the angle of deviation.

In some "soft" formations, such as some sands and shale, we must use a specially designed centralizer or stabilizer for the BHA to function properly. This stabilizer includes a hollow blade element housing which surrounds an inner hollow mandrel which has an external bearing section intermediate the ends thereof. An upper insert is put in the upper annulus between the housing and mandrel above the bearing, and a lower insert in the annulus below the bearing. These inserts each have a larger internal diameter at the outer end than at its inner end. This configuration permits the blade element housing to move with respect to the mandrel to provide the necessary movement so that the center line of the lower collar section can be deflected above the center line of the hole.

BRIEF DESCRIPTION OF THE DRAWINGS

Various objectives and a better understanding can be had of the invention from the following description taken in conjunction with the drawings, in which.

DIRECTIONAL DRILLING BOTTOM HOLE ASSEMBLY DISCUSSION AND THEORY RELATED TO DECREASING THE ANGLE OF DEVIATION

Figure 1:
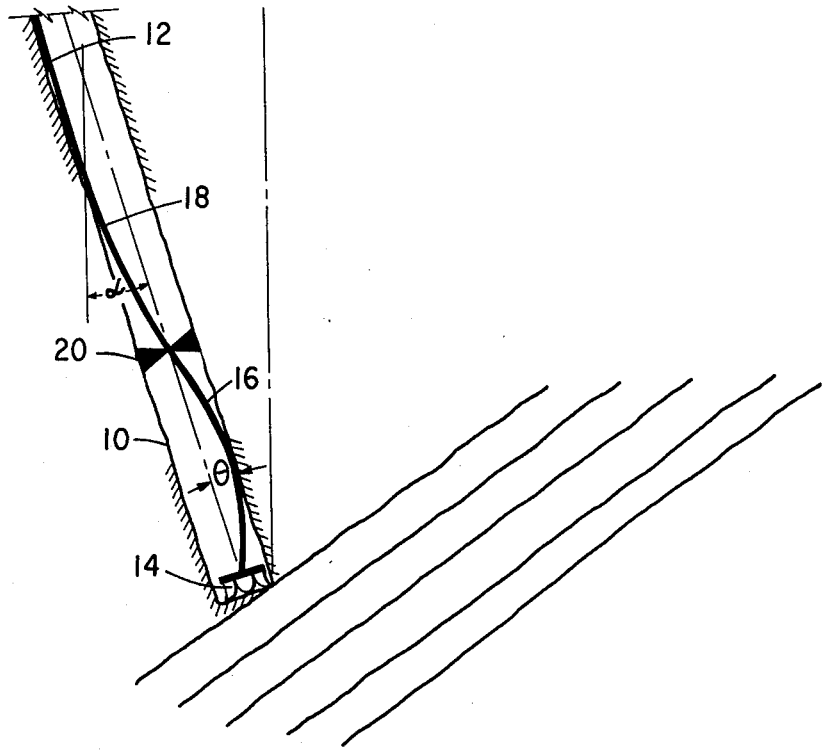
FIG. 1 is a schematic drawing of a BHA useful in decreasing the angle of deviation.

Certain information is necessary in order to analyze the effect of the rate of decrease of deviation in a wellbore. The information that is necessary generally is (1) the formation type (shale, lime, sand, etc.) from IES, and (2) formation dip and dip direction which can be taken from contour maps or accurate dipmeters used on other wells previously drilled in the area. This information is necessary in order that we provide a knowledgeable suggestion as to the bottom hole assembly necessary. If we wish to decrease the bottom hole angle of deviation, we select assembly No. 1, which is shown in FIG. 1. Shown thereof schematically is a sloping or inclined borehole 10 having a drill pipe 12 therein and a bit 14 from the lower end of the drill string. Normally, a drill collar section 16 and 18 are provided. A centralizer 20 is provided between drill collar sections 16 and 18. The drill collars are heavy-walled drill pipe having known physical characteristics.

We next determine that the bottom hole assembly of FIG. 1 is stable for the particular angle of deviation under a condition of zero weight on the bit. This is achieved by taken the following steps:

1. We note the physical dimension of the bottom hole assembly arbitrarily selected.

2. We determine if the selected bottom hole assembly is stable. By this, we mean we determine whether the angle $\theta_0$ is positive. $\theta_0$ is the angle which the center line of the drill collar 16 makes with the center line of the borehole. For $\theta_0$ to be positive, the central line of the collar is above the center line of the borehole.

The method of determining the stability of the bottom hole assembly is based upon the expression or equation (1). If $\theta_0$ is less than zero, then the system is not stable. If $\theta_0$ is positive, i.e., greater than zero, then the system is stable.

$$\theta_O = \theta_{OA} + \theta_{OB} = \frac{d}{dx}\left\{\frac{\omega}{p}\left[\frac{X_1^2}{8} - \frac{EI}{P}\left(1 - \text{Sech}\ \frac{1}{2}\ \frac{X_1}{\sqrt{\frac{EI}{P}}}\right)\right]\right\} + \frac{d}{dx}\left(-\frac{1}{6}\ \frac{M_B X_1}{EI}\right) \quad (1)$$

The following defined terms are used in equation 1 and/or other equations used in this specification and drawings:

$\alpha$ = angle of deviation of borehole from vertical (this is measured).
$\theta_O$ = total angle the drill collars make with center line of borehole.
$\theta_{OA}$ = angle of drill collar relative to bore as a result of axial loads.
$\theta_{OB}$ = angle of drill collar relative to bore as a result of induced moment.
$\omega$ = linear weight per foot of component.

-continued

P = axial load.
$X_1'$ = distance measured from the bit to the first point of collar contact.
$X_1$ = distance measured from the bit to stabilizer.
E = Young's modulus.
I = cross-sectional moment of inertia
$X_2$ = distance measured from the bit to stabilizer.
$X_2'$ = distance measured from the bit to the first point of collar contact.

If $\theta_0$ is positive, then we have a stable system. If $\theta_0$ is less than zero, then the system is not stable and the distance $X_1$ is decreased and $\theta_0$ is recalculated using equation (1) until a stable length is obtained. After the system is determined to be stable, that is, $\theta_0$ is positive.

Figure 2:
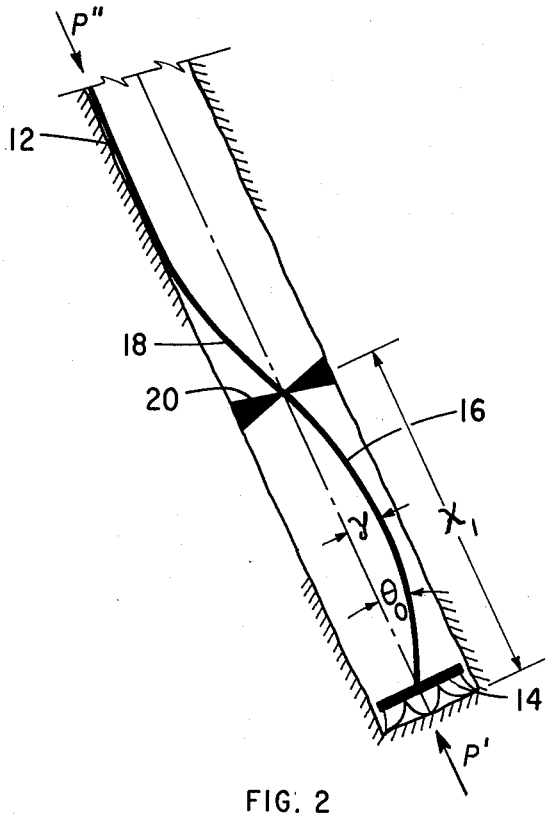
FIG. 2 is a schematic diagram where the lower collar between the stabilizer and bit does not touch the top of the hole; this drawing is useful in describing one of the equations.

After having arrived at a stable configuration for the assembly of FIG. 1, there are two modes in which the lower section of the bottom hole assembly can operate. They are:

Mode 1, where the drill collar 16 does not touch the top of the hole. This is illustrated in FIG. 2.

Figure 3:
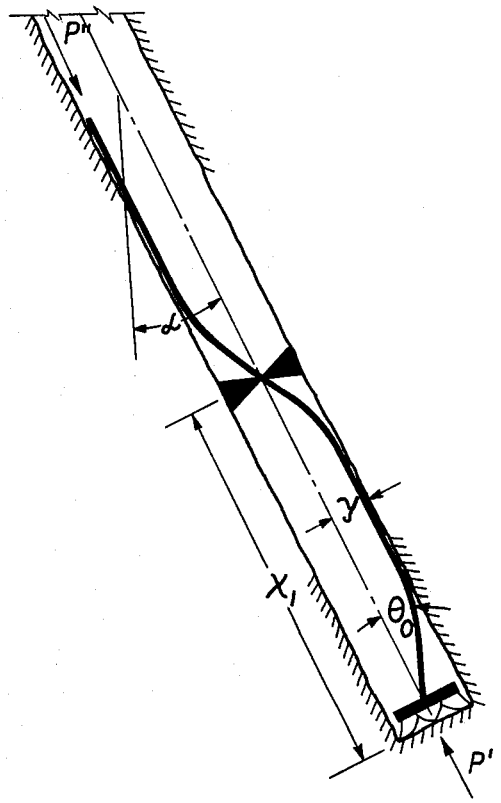
FIG. 3 is similar to FIG. 2, except the collar between the stabilizer and the borehole bit touches the top of the borehole.

Mode 2, where the drill collar 16 touches the top of the hole. This is illustrated in FIG. 3.

For a particular bottom hole assembly, the weight P on the bit determines whether or not the drill collar 16 touches the wall of the borehole. For a given weight and a given downhole configuration, we can use known beam theory to determine whether or not the collar is touching the upper sides of the borehole. The deflection of the drill collar is designated Y. When Y equals or exceeds ½ the diameter clearance, the drill collar is touching the top of the borehole. Otherwise, it is not. The radial clearance is defined as diameter of the hole - diameter of the collar/2

Under most conditions, as more weight is applied on the bit, the collar would invariably touch the top side of the borehole. Then, as more weight on the bit is applied, the collar will contact the top of the hole for a greater distance and thereby create a greater angle $\theta_0'$ at the bit, and thus decrease the angle of deviation at a greater rate.

If we have determined that the drill collar does not touch the top of the hole with no weight, or axial load, as applied to the bit, we use equation (2) to determine whether the configuration is stable.

$$\theta_O' = \theta_A' + \theta_D' = \omega \sqrt{\frac{EI}{P}}\left[-\frac{1}{2}\ \frac{X_1}{\sqrt{\frac{EI}{P}}} + \frac{1 - \cos\sqrt{\frac{EI}{P}}}{\sin\sqrt{\frac{EI}{P}}}\right] + \frac{1}{6}\ \frac{M_B' N}{EI} \quad (2)$$

Here, similarly as in regard to equation (1), if $\theta_0'$ is positive, the configuration is stable. If it is not stable, an adjustment must be made, preferably the distance of X, so that it will be a stable configuration.

If it is determined that the collar touches the top of the borehole, as is illustrated in FIG. 3, then we use equation (3) to determine the angle $\theta_0'$.

$$\theta_0' = \theta_A + \theta_B'$$

$$= \frac{\omega}{P}\left\{\frac{1}{\cos\frac{X_1'}{\sqrt{\frac{EI}{P}}}} - \sqrt{\frac{EI}{P}}\,\frac{\left(1-\cos 2\frac{X_1'}{\sqrt{\frac{EI}{P}}}\right)}{\sin 2\frac{X_1'}{\sqrt{\frac{EI}{P}}}}\right\} \quad (3)$$

Again, if $\theta_0'$ is positive, the configuration is stable. If it is not stable, an adjustment must be made.

BOTTOM HOLE ASSEMBLY TO INCREASE THE ANGLE OF DEVIATION

Figure 4:
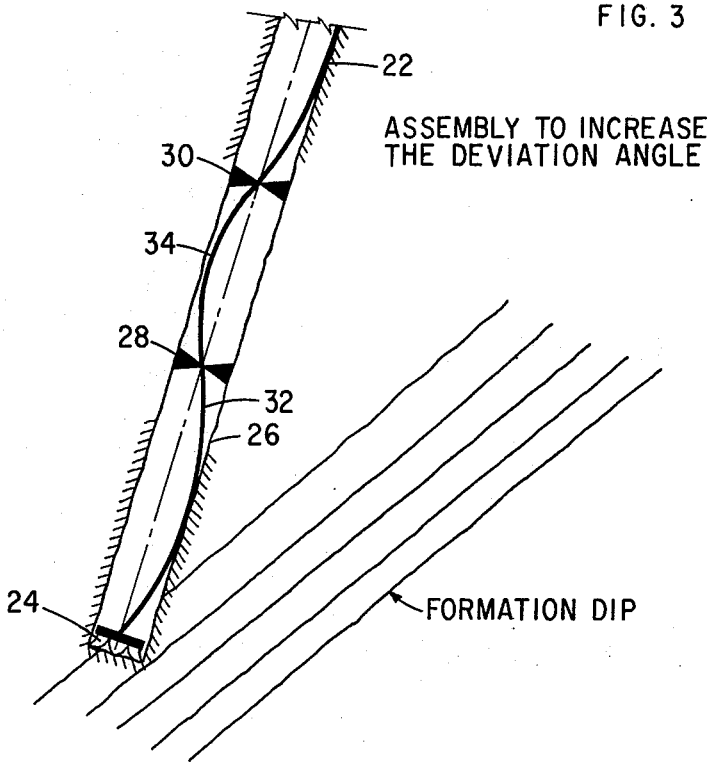
FIG. 4 is a schematic drawing of a downhole assembly useful to increase the angle of deviation.

In some cases, it is desired to increase the angle of deviation of a wellbore and we use the general configuration illustrated in FIG. 4. Shown thereon is a drill string 22 and a bit 24 at the lower end of the hole 26. We provide a lower centralizer 28 and an upper centralizer 30. A drill collar 32 is provided between the centralizer 28 and bit 24 and then upper drill collar section 34 is provided between centralizers 28 and 30.

Figure 5:
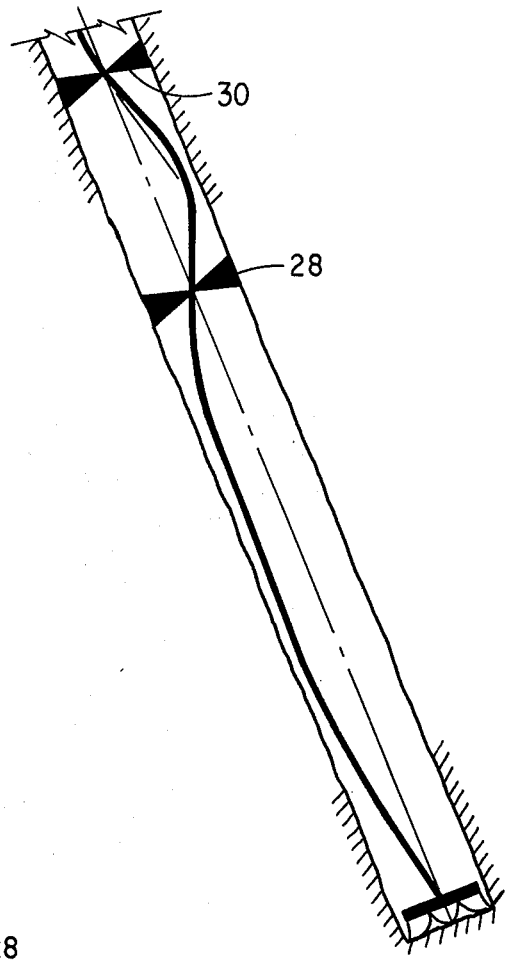
FIG. 5 is a schematic drawing useful in describing the function of some of the equations used in the disclosure, and is useful in explaining the borehole assembly which increases the angle of deviation.

We shall now discuss general topics as related to increasing the angle of deviation of the hole. It is assumed that this system is stable. There are two modes in which the lower section, that is, drill collar 32, can be operated. These are:

Mode 1, where the collar 32 does not touch the bottom of the hole, as indicated in FIG. 5.

Figure 6:
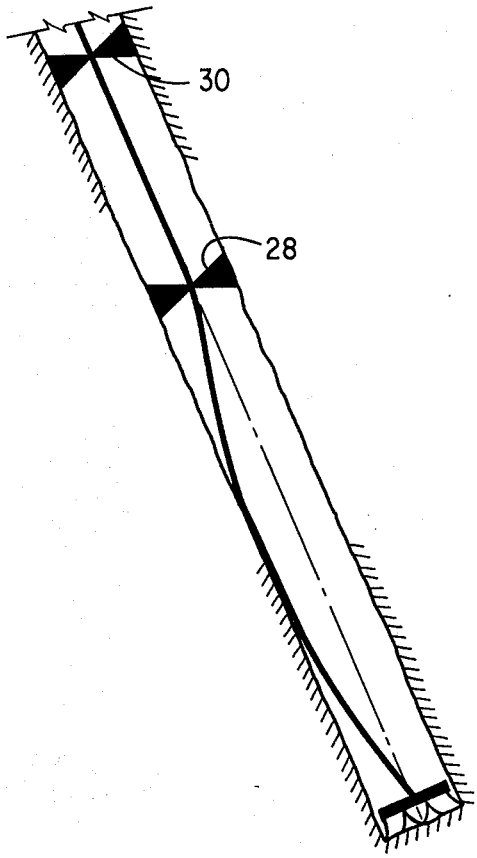
FIG. 6 is similar to FIG. 5 except, in this case, the lower drill collar touches the lower side of the borehole wall.

Mode 2, where the collar does touch the bottom part of the hole and is tangent over some distance, as is illustrated in FIG. 6.

The angle $\theta$ is a function of the physical bottom hole assembly configuration and the amount of weight applied to the bit. As the weight on the bit is increased, the collar will move downward since in its initial position it is below the center line of the hole, and this will thereby increase the value of $\theta$ and tend to increase the angle of deviation of the hole. This can be seen in equation (4), which is the equation for determining the angle $\theta$ for the configuration of FIG. 5.

$$\theta = \frac{\omega}{P}\sqrt{\frac{EI}{P}}\left[-\frac{1}{2}\,\frac{X_2}{\sqrt{\frac{EI}{P}}} + \frac{1-\cos\frac{X_2}{\sqrt{\frac{EI}{P}}}}{\sin\frac{X_2}{\sqrt{\frac{EI}{P}}}}\right] \quad (4)$$

In mode 2, as illustrated in FIG. 6, the collars are lying in the lower section on the low side of the borehold. As more weight is applied to the bottom hole assembly, it will increase the angle of deviation of the hole. As more weight is applied, likewise, the point of tangency of the collar with respect to the borehole at the lowermost point moves toward the bit. As this moves toward the bit, it in turn increases, just as in mode 1, the angle of deviation of the bit. Equation (5), which is given below, is the appropriate one for determining the deviation angle $\theta$ for the configuration of FIG. 6.

$$\theta = \frac{-\omega}{P}\sqrt{\frac{EI}{P}}\left[-\frac{1}{2}\,\frac{X_2'}{\sqrt{\frac{ET}{P}}} + \frac{1-\cos\frac{X_2'}{\sqrt{\frac{EI}{P}}}}{\sin\frac{X_2'}{\sqrt{\frac{EI}{P}}}}\right] \quad (5)$$

UNIVERSAL STABILIZER

Figure 7:
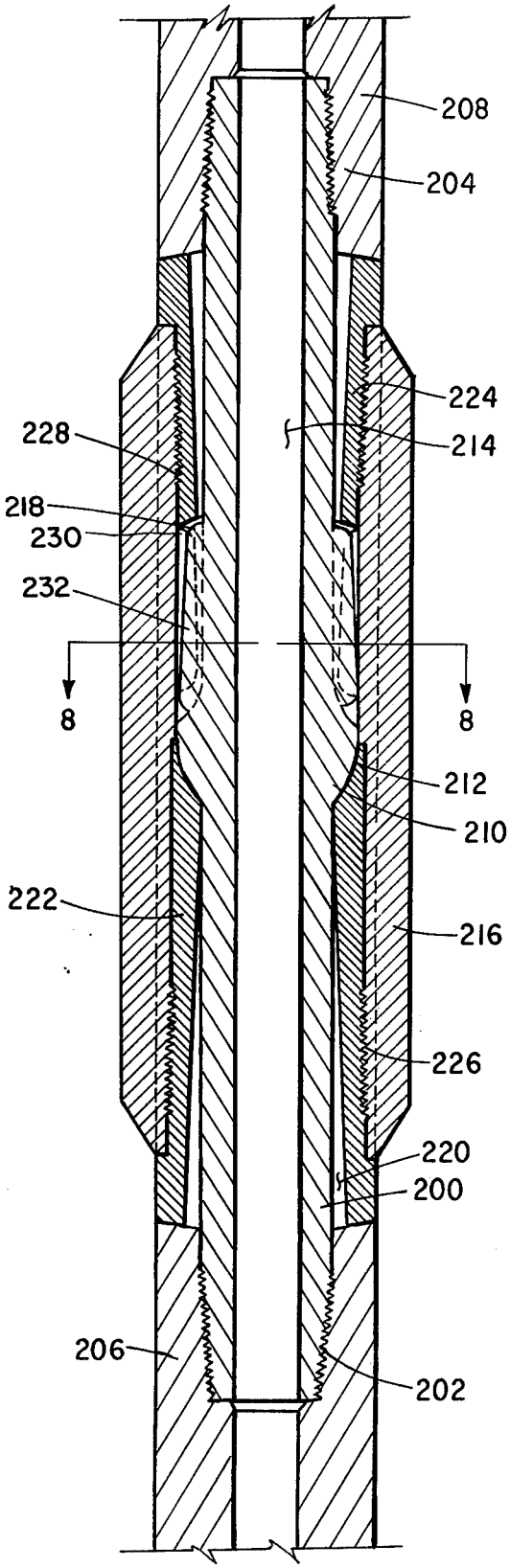
FIG. 7 is a longitudinal sectional view of a novel universal stabilizer useful in the BHA.
Figure 8:
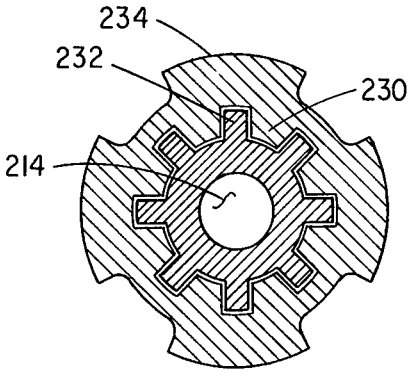
FIG. 8 is a cross-sectional view taken along the line 8—8 of FIG. 7.

Attention is next directed to FIG. 7 which shows a universal stabilizer especially adapted for use in drilling so-called "soft" formations using the bottom hole assemblies described above. By "soft" formations, we usually mean sand or shale formations as contrasted with hard shale, limestone, or granite. Shown thereon is an inner hollow mandrel 200 having a threaded lower end 202 and a threaded upper end 204. These are for attachments, respectively, to lower sub 206 and upper sub 208, which form a part of the drilling string. Intermediate ends 202 and 204, mandrel 200 has an enlarged bearing portion 210 which has bearing surface 212. Bearing surface 212 is presented as a portion of a sphere. The mandrel also has a longitudinal passage 214 which is preferably of the same diameter as subs 206 and 208.

A hollow blade element housing 216 having blades 234 surrounds the mandrel 200. The inner diameter of housing 216 is approximately the same as the diameter of the enlarged portion 210 of the mandrel. This leaves an upper annulus 218 and a lower annulus 220 between the housing and the mandrel. Lower insert 222 and upper insert 224 are inserted in annulus 220 and 218, respectively. The outer ends of the inserts have slightly larger diameters than the outer diameter of the mandrel 200, whereas the inner ends of the inserts have approximately the same diameter. Thus, the inserts make an angle $\beta$ with the mandrel. This angle is ordinarily not over 2° and is preferably about 1½° for most operations. The upper end of lower insert 222 complements the bearing surface 212 of bearing 210 of the mandrel. The upper insert 224 terminates considerably above the enlarged bearing 210.

Inserts 222 and 224 are connected to housing 216 by threads 226 and 228, respectively. When the tool is made up, the upper surface of upper insert 224 has a sliding contact with the lower surface of sub 208. The same is true of the lower surface of lower insert 222 and the upper base of lower sub 206. These mating surfaces can be defined by a radius R having a center at the middle of the enlarged bearing portion.

Means will now be discussed which permits a housing 216 to be rotated with the mandrel 200. This includes inner splines 230 on the inner wall of housing 216. Mating splines 232 are provided on the internal wall of housing 216. Splines 230 and 232 are in the annulus space between upper insert 224 and bearing member 210.

While the tool may take on various dimensions, we shall now give typical dimensions for an 8¾ inch universal stabilizer. The mandrel 200 is 40 inches in length with the bearing 210 in approximately the center thereof. The internal passageway is 2 inches and the external diameter is 4 inches. The radius of bearing member 210 is 2.75 inches. Stabilizer housing 216 is about 25 inches long. The outer diameter of the housing, including the fins 234, is 8¾ inches, and the diameter of the valley of the housing is 6¾ inches. The bottom insert is approximately 15 inches in length, and the upper insert is about 8½ inches long.

While the above description has been given in detail, it is possible to modify the embodiments shown without departing from the spirit or scope of the invention.

We claim:

1. A stabilizer for use in a string of drill pipe which includes:

an inner hollow mandrel having an enlarged bearing section on the outer surface intermediate the ends thereof;

a hollow blade element housing surrounding said mandrel, the inner diameter of said housing being about equal to the diameter of said bearing section of said mandrel so as to form an upper annulus between the mandrel and housing on one side of said bearing section and a lower annulus on the other side thereof;

an upper insert in said upper annulus, said upper insert being annular in shape and having a larger internal diameter at the outer end than at the inner end; and a lower annular insert in said lower annulus, said lower insert having a larger internal diameter at the outer end than at the inner end.

2. An apparatus as defined in claim 1 in which said inserts are each fixed to the blade element housing.

3. An apparatus as defined in claim 1 including external splines on the external surface of said mandrel between the bearing section and the upper insert and mating internal splines on the blade element housing.

4. An apparatus as defined in claim 1 in which the angle of the internal surface of the insert with the outer wall of said mandrel is not over about 2°.

5. An apparatus as defined in claim 4 in which said angle is about 1½°.

6. A bottom-hole assembly of a drill string used in drilling a well in soft formations and used to decrease the angle of deviation of the borehole from the vertical, which comprises:

a bit;

a lower section of heavy-walled pipe connected at its lower end to said bit;

a centralizer connected to the upper end of said heavy-walled pipe, said centralizer including:

an inner hollow mandrel having an enlarged bearing section on the outer surface intermediate the ends thereof;

a hollow blade element housing surrounding said mandrel, the inner diameter of said housing being about equal to the diameter of said bearing section of said mandrel so as to form an upper annulus between the mandrel and housing on one side of said bearing section and the lower annulus on the other side thereof;

an upper insert in said upper annulus, said upper insert being angular in shape and having a larger internal diameter at the outer end than at the inner end;

a lower annular insert in said lower annulus, said lower insert having a larger internal diameter at the outer end than at the inner end.

* * * * *